US009959876B2

(12) United States Patent
Kim et al.

(10) Patent No.: US 9,959,876 B2
(45) Date of Patent: May 1, 2018

(54) CLOSED LOOP QUANTIZATION OF HIGHER ORDER AMBISONIC COEFFICIENTS

(71) Applicant: QUALCOMM Incorporated, San Diego, CA (US)

(72) Inventors: Moo Young Kim, San Diego, CA (US); Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 147 days.

(21) Appl. No.: 14/712,638

(22) Filed: May 14, 2015

(65) Prior Publication Data

US 2015/0332681 A1 Nov. 19, 2015

Related U.S. Application Data

(60) Provisional application No. 61/994,493, filed on May 16, 2014, provisional application No. 61/994,788,
(Continued)

(51) Int. Cl.
*G10L 19/008* (2013.01)
*G10L 19/038* (2013.01)
(Continued)

(52) U.S. Cl.
CPC ..... *G10L 19/008* (2013.01); *G10L 19/032* (2013.01); *G10L 19/038* (2013.01);
(Continued)

(58) Field of Classification Search
None
See application file for complete search history.

(56) References Cited

U.S. PATENT DOCUMENTS 7,299,190 B2 * 11/2007 Thumpudi ..... G10L 19/032 704/200.1
8,706,480 B2 4/2014 Herre et al.
(Continued)

FOREIGN PATENT DOCUMENTS

WO 2014194099 A1 12/2014

OTHER PUBLICATIONS

International Preliminary Report on Patentability issued by the International Bureau in international application No. PCT/US2015/031107 dated Dec. 1, 2016, 8 pp.
(Continued)

*Primary Examiner* — Paul Huber
(74) *Attorney, Agent, or Firm* — Shumaker & Sieffert, P.A.

(57) ABSTRACT

In general, techniques are described for closed loop quantization of HOA coefficients that provide a three-dimensional representation of the sound field. An audio encoding device may perform closed loop quantization of an audio object based at least in part on a result of performing quantization of directional information associated with the audio object. An audio decoding device may obtain an audio object that has been closed loop quantized based at least in part on a result of performing quantization of directional information associated with the audio object, and may dequantize the audio object.

32 Claims, 12 Drawing Sheets

Related U.S. Application Data filed on May 16, 2014, provisional application No. 62/004,082, filed on May 28, 2014.

(51) Int. Cl.

| | |
|---|---|
| ***H04S 3/02*** | (2006.01) |
| ***H04S 5/00*** | (2006.01) |
| ***G10L 19/032*** | (2013.01) |
| *G10L 19/20* | (2013.01) |

(52) U.S. Cl.

CPC ..... *H04S 3/02* (2013.01); *H04S 5/005* (2013.01); *G10L 19/20* (2013.01); *H04S 2400/01* (2013.01); *H04S 2420/11* (2013.01)

(56) References Cited

U.S. PATENT DOCUMENTS

| | | | | |
|---|---|---|---|---|
| 2008/0015852 | A1* | 1/2008 | Kruger | G10L 19/12 704/225 |
| 2012/0155653 | A1 | 6/2012 | Jax et al. | |
| 2013/0144630 | A1 | 6/2013 | Thumpudi et al. | |
| 2013/0317811 | A1 | 11/2013 | Grancharov et al. | |
| 2014/0249828 | A1* | 9/2014 | Grancharov | G10L 19/06 704/500 |
| 2014/0358565 | A1 | 12/2014 | Peters et al. | |
| 2015/0213803 | A1 | 7/2015 | Peters et al. | |

OTHER PUBLICATIONS

"Information technology—High efficiency coding and media delivery in heterogeneous environments—Part 3: 3D Audio," DVB Organization, ISO-IEC_23008-3_(E)_(DIS of 3DA).docx, Digital Video Broadcasting, C/0 EBU-17A Ancienne Route-CH-1218 Grand Saconnex, Geneva, CH, Aug. 8, 2014, 431 pp., XP017845569.

Solvang et al., "Quantization of 2D Higher Order Ambisonics wave fields," Convention Paper 7370, AES Convention P124; May 2008, AES, 60 East 42nd Street, Room 2520, New York 10165-2520, USA, May 2008, XP040508586, 9 pp.

International Search Report and Written Opinion from International Application No. PCT/US2015/031107, dated Aug. 4, 2015, 11 pp.

"Information technology—High efficiency coding and media delivery in heterogeneous environments—Part 3: 3D Audio," ISO/IEC JTC 1/SC 29, Jul. 25, 2014, 311 pp.

Zotter et al., "Energy-Preserving Ambisonic Decoding," Acta Acustica United With Acustica, European Acoustics Association, Stuttgart, DE: Hirzel, vol. 98, No. 1, Jan. 2012, pp. 37-47, XP009180661, ISSN: 1436-7947, DOI : 10.3813/AAA.918490.

Ahonen et al., "Directional Analysis with Microphone Array Mounted on Rigid Cylinder for Directional Audio Coding," J. Audio Eng. Soci. vol. 60, No. 5, May 2012, pp. 311-324.

"Call for Proposals for 3D Audio," ISO/IEC JTC1/SC29/WG11/N13411, Jan. 2013, 20 pp.

Poletti, "Three-Dimensional Surround Sound Systems Based on Spherical Harmonics," J. Audio Eng. Soc., vol. 53, No. 11, Nov. 2005 pp. 1004-1025.

"Information technology—High efficiency coding and media delivery in heterogeneous environments—Part 3: 3D Audio," ISO/IEC JTC 1/SC 29N, Apr. 4, 2014, 337 pp.

Herre et al., "MPEG-H 3D Audio—The New Standard for Coding of Immersive Spatial Audio," IEEE Journal of Selected Topics in Signal Processing, vol. 9, No. 5, Aug. 2015, pp. 770-779.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.

* cited by examiner

CLOSED LOOP QUANTIZATION OF HIGHER ORDER AMBISONIC COEFFICIENTS

This application claims the benefit of the following U.S. Provisional Applications:

U.S. Provisional Application No. 61/994,493, filed May 16, 2014, entitled "CLOSED LOOP QUANTIZATION OF HIGHER ORDER AMBISONIC COEFFICIENTS;"

U.S. Provisional Application No. 61/994,788, filed May 16, 2014, entitled "CLOSED LOOP QUANTIZATION OF HIGHER ORDER AMBISONIC COEFFICIENTS;" and U.S. Provisional Application No. 62/004,082, filed May 28, 2014, entitled "CLOSED LOOP QUANTIZATION OF HIGHER ORDER AMBISONIC COEFFICIENTS,"

each of foregoing listed U.S. Provisional Applications is incorporated by reference as if set forth in their respective entirety herein.

TECHNICAL FIELD

This disclosure relates to audio data and, more specifically, quantization of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for closed loop quantization of HOA coefficients that provide a three-dimensional representation of the sound field. Instead of performing separate and independent quantization of an audio object and the directional information associated with the audio object (both of which may be decomposed from the HOA coefficients) using an open loop quantization process, an audio encoder may quantize the audio object based at least in part on the quantized directional information associated with the audio object. In this way, the quantized audio object may compensate for the quantization errors that result from quantizing the directional information associated with the audio object. Furthermore, the three-dimensional representation of the sound field encoded via closed loop quantization may be reconstructed by a decoder with relatively less quantization error than the three-dimensional representation of the sound field encoded via an open loop quantization.

In one aspect, a method for quantizing a foreground audio signal comprises performing, by at least one processor, closed loop quantization of an audio object based at least in part on a result of performing quantization of directional information associated with the audio object.

In another aspect, a device for quantizing a foreground audio signal includes a memory. The device further includes at least one processor configured to perform closed loop quantization of an audio object based at least in part on a result of performing quantization of directional information associated with the audio object In another aspect, a method for dequantizing an audio object comprises obtaining, by at least one processor, an audio object that has been closed loop quantized based at least in part on a result of performing quantization of directional information associated with the audio object and dequantizing, by the at least one processor, the audio object.

In another aspect, a device for dequantizing an audio object includes a memory. The device further includes at least one processor configured to obtain an audio object that has been closed loop quantized based at least in part on a result of performing quantization of directional information associated with the audio object and dequantize the audio object.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
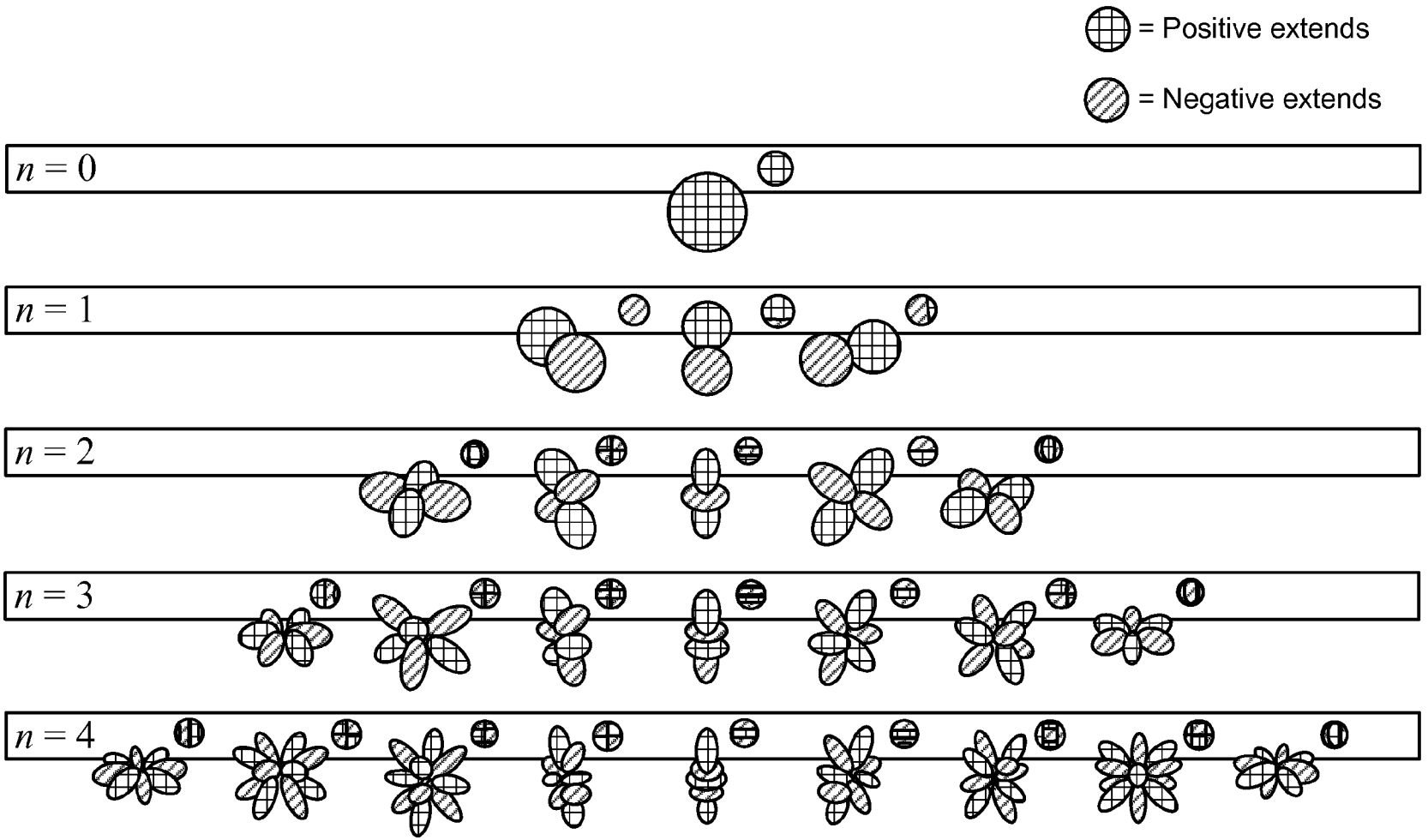
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^2(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of object-based and SHC-based audio coding.

Figure 2:
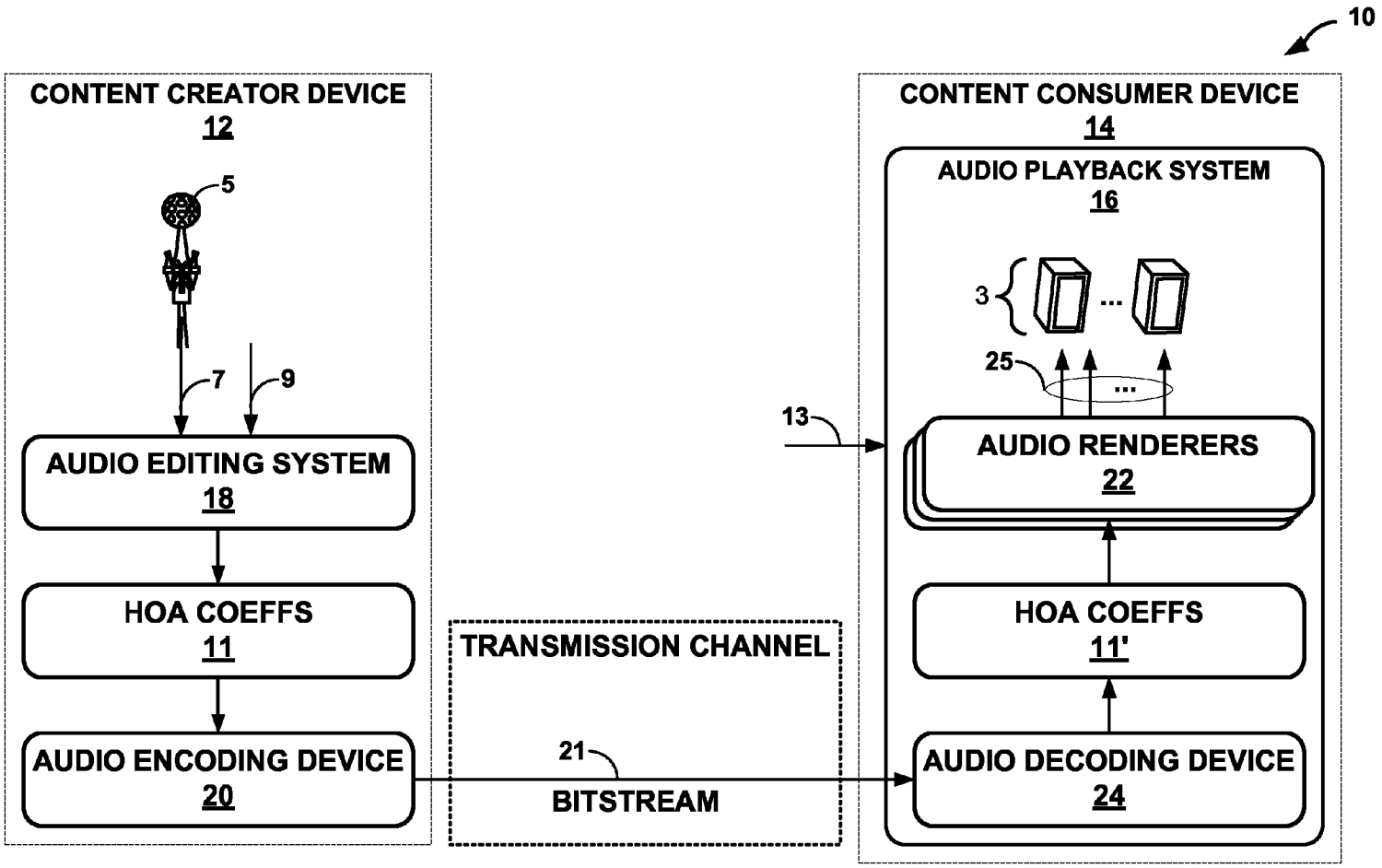
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

Figure 3:
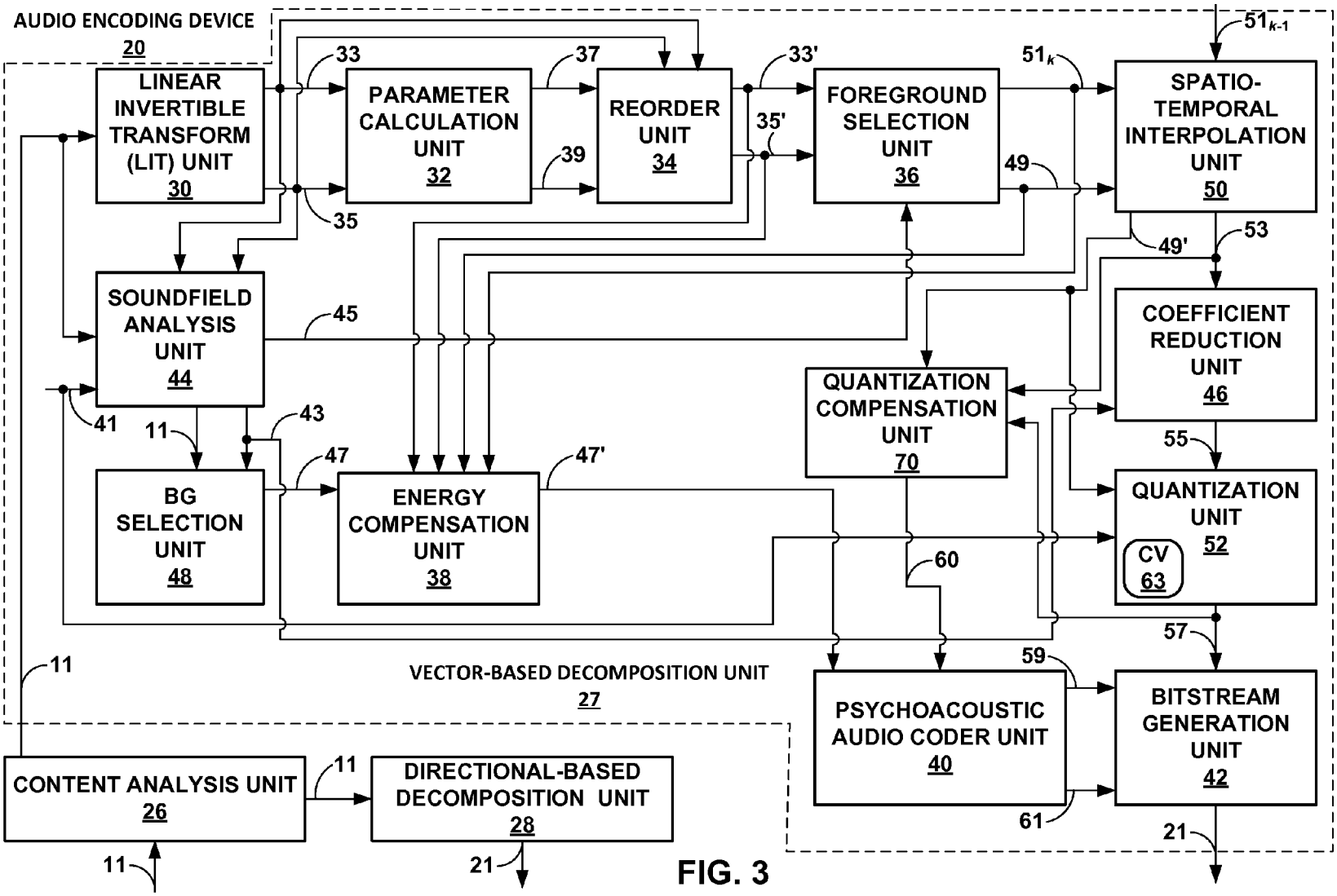
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May, 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based decomposition unit 28. The directional-based decomposition unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2 \times (N+1)^2$. Individual vector elements in the US[k] matrix may also be termed $X_{PS}$ (k) while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document. Furthermore, throughout this document, US[k], which represents the audio signal with energies may be referred to by the term "audio object" or "foreground audio signal" and V[k] may be referred to as "directional information associated with the audio object" or "directional information associated with the foreground signal." HOA[k] coefficients may be referred to as HOA coefficients, where HOA coefficients=US[k]*V[k] or, in other words, the HOA coefficients are the product of an audio object (US[k]) and directional information associated with the audio object (V[k]).

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, ω, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3). The background channel information 43 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+nBGa]$. The ambient HOA coefficients 47 may also be referred to as "ambient HOA coefficients 47," where each of the ambient HOA coefficients 47 corresponds to a separate ambient HOA channel to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the quantization compensation unit 70, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\nabla_{1,\ldots,nFG}[k]$) having dimensions D: $(N+1)^2\times$ nFG.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 40 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times$nFG. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, and outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure. In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 42 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The quantization compensation unit 70 included within the audio encoding device 20 may represent a unit configured to receive the interpolated nFG signals 49' and the interpolated foreground V[k] vectors 53 from spatio-temporal interpolation unit 50, as well as the coded foreground V[k] vectors 57 from quantization unit 52, to perform quantization compensation with respect to the nFG signals 49' in order to compensate for quantization errors that result from quantizing the interpolated foreground V[k] vectors 53. The quantization compensation unit 70 may generate and output quantization-compensated nFG signals 60 to the psychoacoustic audio coder unit 40.

To determine the quantization-compensated nFG signals 60, the quantization compensation unit 70 may, because the coded foreground V[k] vectors 57 is a matrix, perform a pseudoinverse function on the coded foreground V[k] vectors 57 to obtain a pseudoinverse of the coded foreground V[k] vectors 57. The pseudoinverse function may, in some examples, be a generalized inverse function or a Moore-Penrose pseudoinverse function. The quantization compensation unit 70 may compute a product of the pseudoinverse of the coded foreground V[k] vectors 57 and the foreground HOA coefficients to determine intermediate quantization-compensated nFG signals. For example, quantization compensation unit 70 may determine the foreground HOA coefficients as the product of the interpolated nFG signals 49' and the interpolated foreground V[k] vectors 53. By being generated as a result of the product of the pseudoinverse of the coded foreground V[k] vectors 57 and the foreground HOA coefficients, the intermediate quantization-compensated nFG signals generated by quantization compensation unit 70 may compensate for quantization errors introduced by the coded foreground V[k] vectors 57 because the intermediate quantization-compensated nFG signals are calculated based at least in part on the coded foreground V[k] vectors 57 instead of the interpolated foreground V[k] vectors 53. Therefore, audio encoding device 20 may thereby compensate for any errors introduced in quantizing interpolated foreground V[k] vectors 53 in quantizing quantization-compensated nFG signals 60.

The quantization compensation unit 70 may further crossfade a portion of the intermediate quantization-compensated nFG signals of the current frame k with a portion of the intermediate quantization-compensated nFG signals of the previous frame k−1 to produce the quantization-compensated nFG signals 60. For instance, the quantization compensation unit 70 may crossfade the first 256 samples of the intermediate quantization-compensated nFG signals of the current frame k with the last 256 samples of the intermediate-quantization-compensated nFG signals of the previous frame k−1 to produce the quantization-compensated nFG signals 60 of size 1024 by 2. In some examples, the quantization compensation unit 70 may not crossfade the intermediate quantization-compensated nFG signals of the current frame k with the intermediate quantization-compensated nFG signals of the previous frame k−1. In this case, quantization-compensated nFG signals 60 may be the same as the intermediate quantization-compensated nFG signals.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the quantization-compensated nFG signals 60 to generate encoded ambient HOA coefficients 59 and encoded nFG signals 61. Generating the encoded ambient HOA coefficients 59 may include performing quantization of energy compensated ambient HOA coefficients 47', and generating the encoded nFG signals 61 may include performing quantization of the quantization-compensated nFG signals 60. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21 as described below in more detail with respect to the example of FIG. 7. The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstream 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER_ORDER AMBISONIC COEFFICIENTS," filed Jan. 12, 2015.

Figure 4:
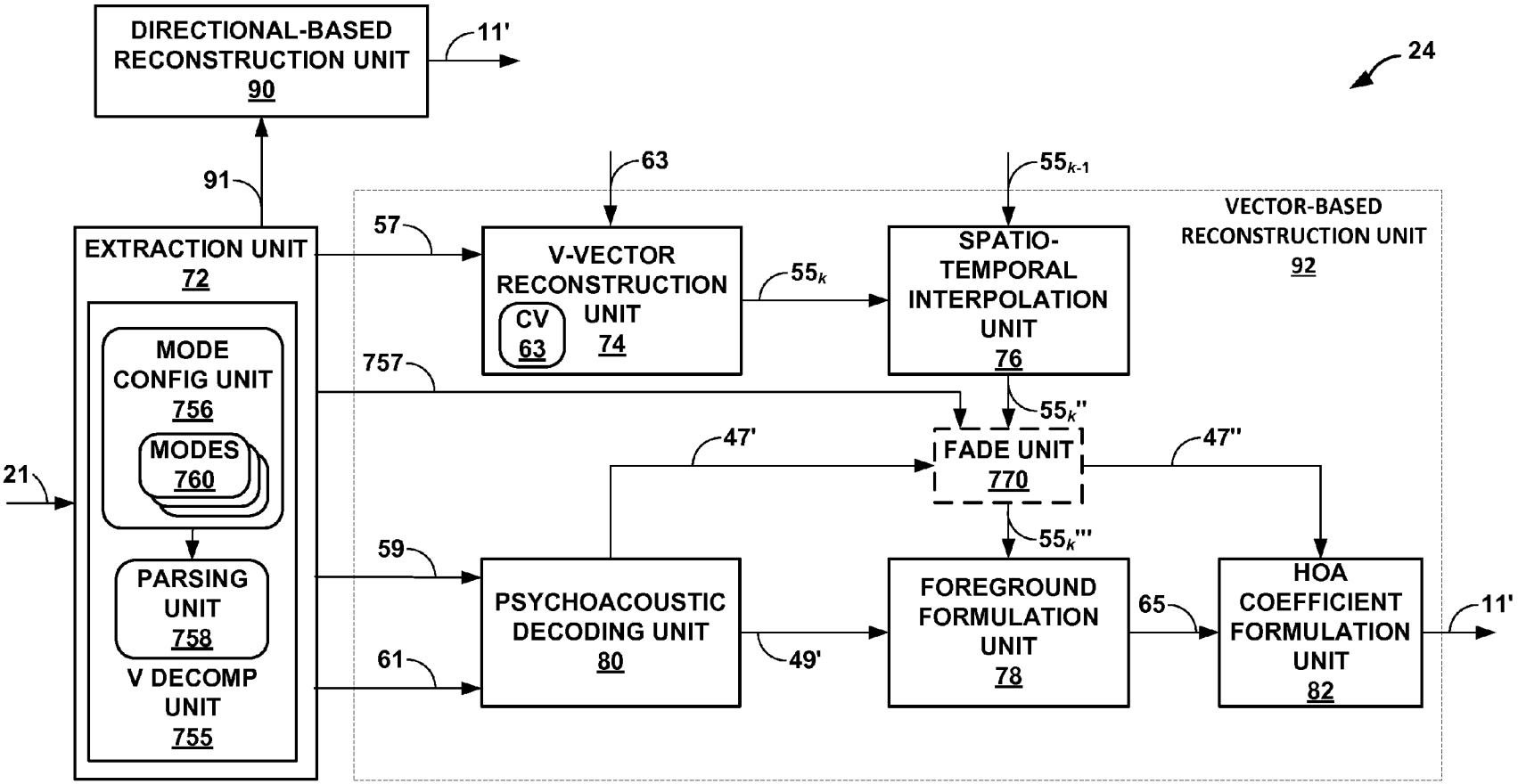
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May, 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91. The bitstream and the arrangement of syntax elements within the bitstream is described below in more detail with respect to the example of FIGS. 7A-7J.

When the syntax element indicates that the HOA coefficients 11 were encoded using a vector-based synthesis, the extraction unit 72 may extract the coded foreground V[k] vectors 57 (which may include coded weights and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic audio decoding unit 80.

The V-vector reconstruction unit 74 (also known as a dequantization unit) may represent a unit configured to reconstruct the V-vectors (e.g., the reduced foreground V[k] vectors $\mathbf{55}_k$) from the encoded foreground V[k] vectors 57. The V-vector reconstruction unit 74 may operate in a manner reciprocal to that of the quantization unit 52 to dequantize the encoded foreground V[k] vectors 57 to generate the reduced foreground V[k] vectors $\mathbf{55}_k$.

In some examples, V-vector reconstruction unit 74 may crossfade a portion of the coded foreground V[k] vectors 57 of the current frame with a portion of the coded foreground V[k−1] vectors of the previous frame to produce crossfaded and quantized foreground V[k] vectors. For example, extraction unit 72 may crossfade the first 256 samples of the coded foreground V[k] vectors 57 of the current frame k with the last 256 samples of the quantized foreground V[k−1] vectors of the previous frame k−1 and dequantize the crossfaded and quantized foreground V[k] vectors to generate the reduced foreground V[k] vectors $\mathbf{55}_k$.

The psychoacoustic audio decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic audio decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'''" or "ambient HOA coefficients 47'''") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47'' to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47'' so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 5A:
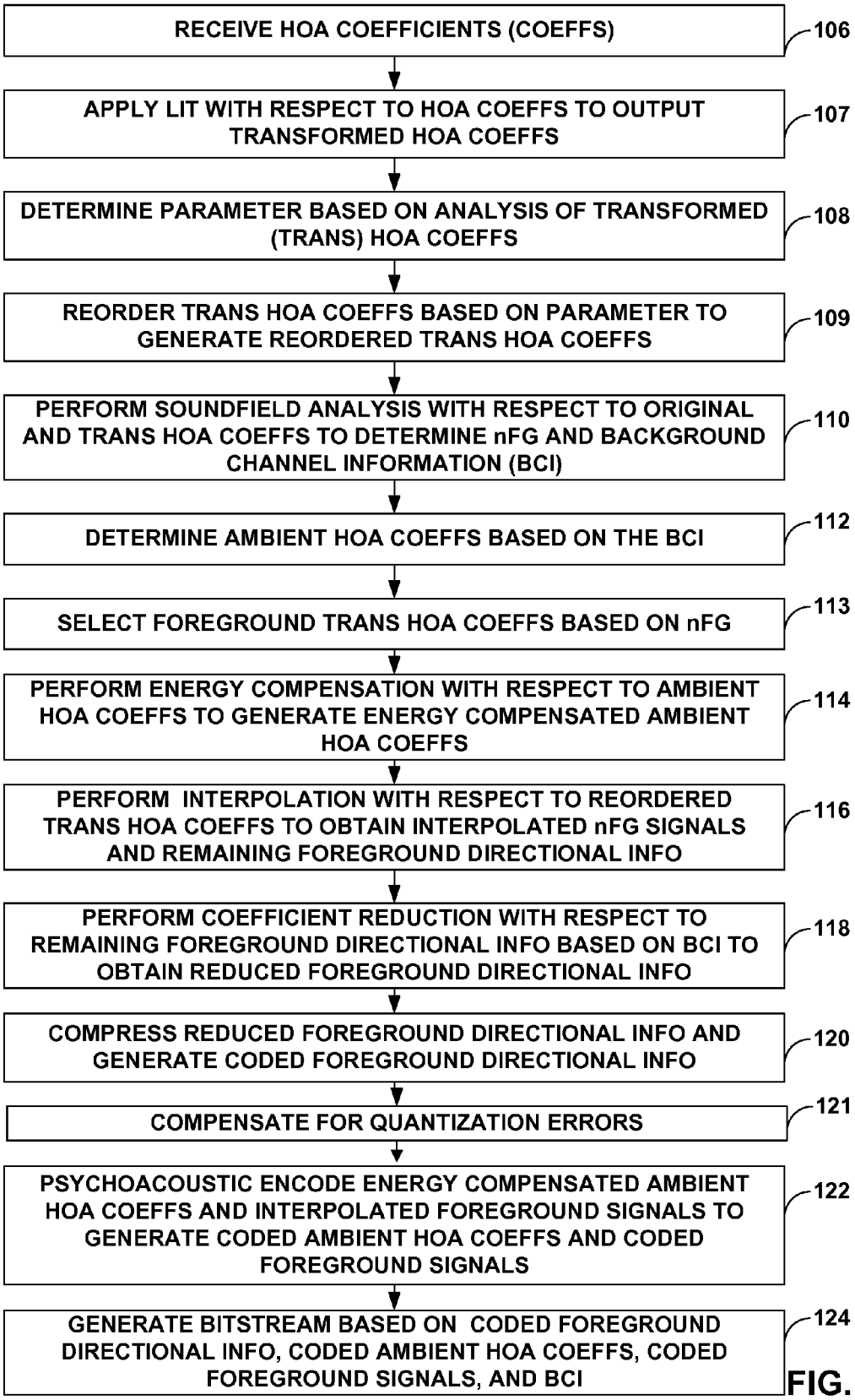
FIG. 5A is a flowchart illustrating exemplary operation of an audio encoding device in performing various aspects of the vector-based synthesis techniques described in this disclosure.

FIG. 5A is a flowchart illustrating exemplary operation of an audio encoding device, such as the audio encoding device 20 shown in the example of FIG. 3, in performing various aspects of the vector-based synthesis techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US[k] vectors 33' and the reordered V[k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 (114) and thereby generate energy compensated ambient HOA coefficients 47'.

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the quantization unit 52 to compress, in the manner described above, the reduced foreground V[k] vectors 55 and generate coded foreground V[k] vectors 57 (120).

The audio encoding device 20 may invoke quantization compensation unit 70. The quantization compensation unit 70 may compensate for the quantization errors of coded foreground V[k] vectors 57 to produce quantization-compensated nFG signals 60 (121)

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 5B:
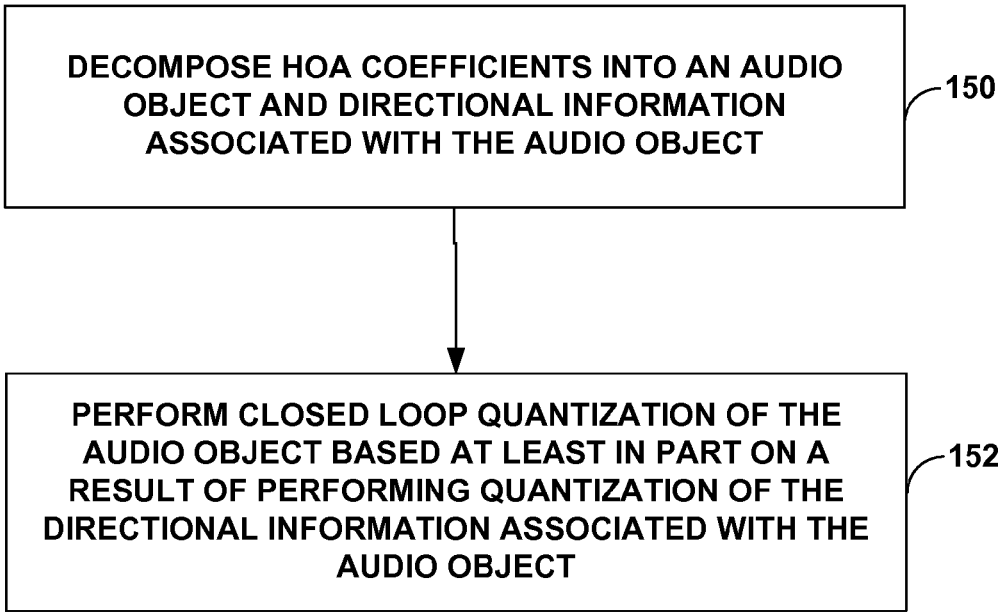
FIG. 5B is a flowchart illustrating exemplary operation of an audio encoding device in performing various aspects of the coding techniques described in this disclosure.

FIG. 5B is a flowchart illustrating exemplary operation of an audio encoding device in performing the coding techniques described in this disclosure. As shown in FIG. 5B, LIT unit 30 of audio encoding device 20 may decompose HOA coefficients into an audio object and directional information associated with the audio object (150). The audio object may comprise a product of a U matrix representative of left-singular vectors of a plurality of spherical harmonic coefficients and a S matrix representative of singular values of the plurality of spherical harmonic coefficients. The directional information associated with the audio object may comprise a V matrix representative of right-singular vectors of the plurality of spherical harmonic coefficients.

Psychoacoustic audio coder unit 40 of audio encoding device 20 may perform closed loop quantization of the audio object based at least in part on a result of performing quantization of the directional information associated with the audio object (152). Audio encoding device 20 may perform the closed loop quantization of the audio object by performing quantization of the directional information associated with the audio object and performing quantization of a the audio object based at least in part on a result of performing quantization of the directional information associated with the audio object. Audio encoding device 20 may perform quantization (i.e., quantize) of the audio object by performing quantization (i.e., quantize) of the audio object based at least in part on a quantization error resulting from performing quantization (i.e., quantize) of the directional information associated with the audio object.

Audio encoding device 20 may perform quantization of the audio object based at least in part on the quantization error resulting from performing quantization of the directional information associated with the audio object by compensating for the quantization error resulting from performing quantization of the directional information associated with the audio object. Audio encoding device 20 may compensate for the quantization error resulting from performing quantization of the directional information associated with the audio object by determining a quantization-compensated audio object based at least in part on a pseudoinverse of a result of performing quantization of the directional information associated with the audio object and performing quantization of the quantization-compensated audio object.

Audio encoding device 20 may determine the quantization-compensated audio object based at least in part on the pseudoinverse of the result of performing quantization of the directional information associated with the audio object by determining the quantization-compensated audio object as a product of Higher Order Ambisonics (HOA) coefficients and the pseudoinverse of the result of performing quantization of the directional information associated with the audio object.

Figure 6A:
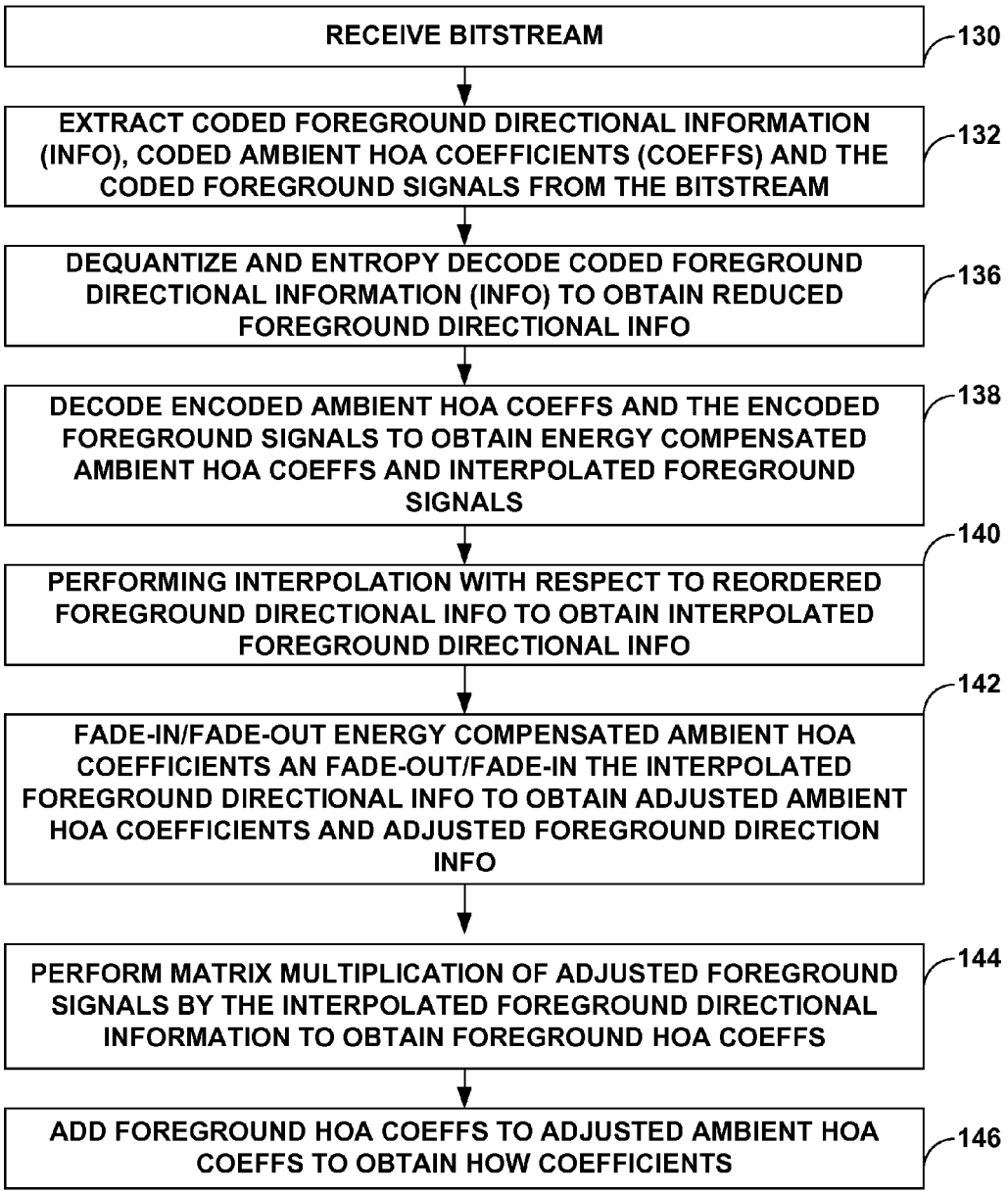
FIG. 6A is a flowchart illustrating exemplary operation of an audio decoding device in performing various aspects of the techniques described in this disclosure.

FIG. 6A is a flowchart illustrating exemplary operation of an audio decoding device, such as the audio decoding device 24 shown in FIG. 4, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 61 or the coded foreground audio objects 59) from the bitstream 21 in the manner described above (132).

The audio decoding device 24 may further invoke the V-vector reconstruction unit 74. The V-vector reconstruction unit 74 may entropy decode and dequantize the coded foreground directional information 57 to obtain reduced foreground directional information $\mathbf{55}_k$ (136). The audio decoding device 24 may also invoke the psychoacoustic audio decoding unit 80. The psychoacoustic audio decoding unit 80 may decode/dequantize the encoded ambient HOA coefficients 59 and the encoded foreground signals 61 to obtain energy compensated ambient HOA coefficients 47' and the interpolated foreground signals 49' (138). The psychoacoustic audio decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (140). The spatio-temporal interpolation unit 76 may forward the interpolated foreground V[k] vectors $\mathbf{55}_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k''$ outputting the adjusted foreground V[k] vectors $\mathbf{55}_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

Figure 6B:
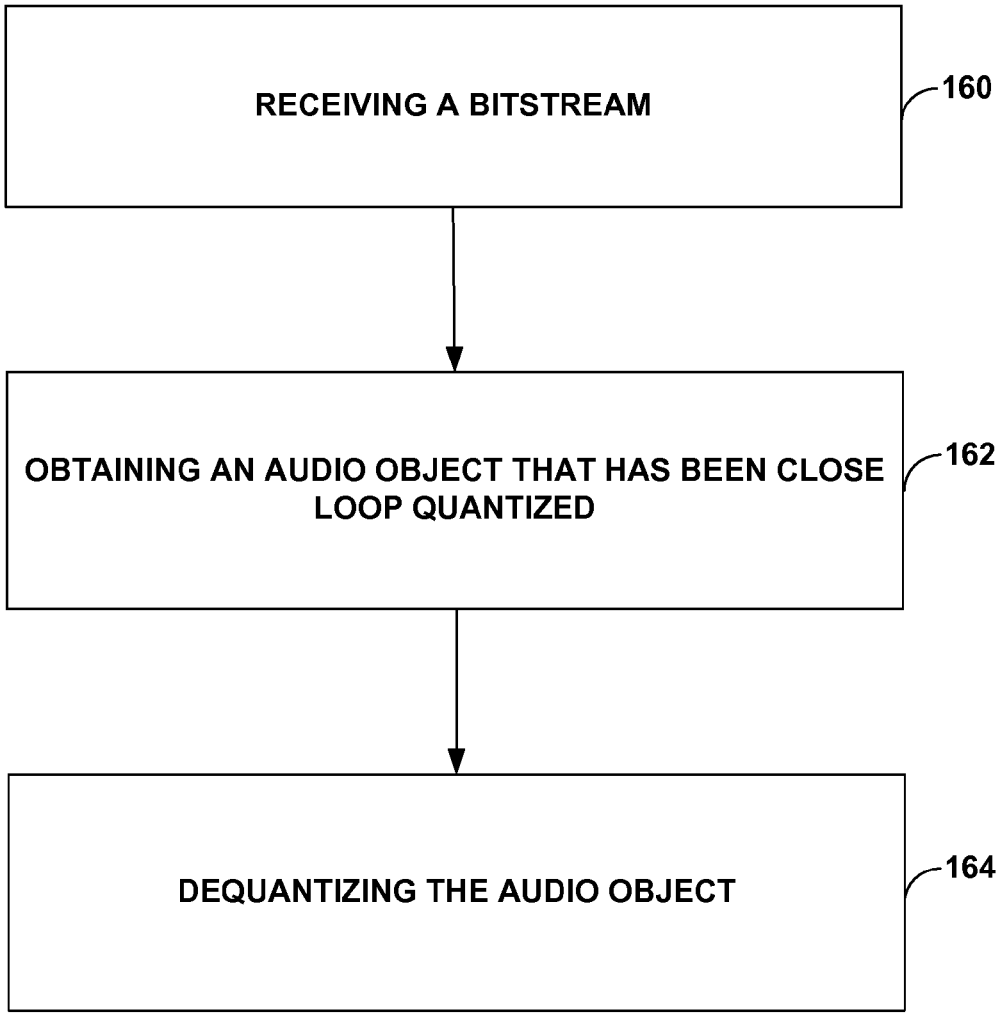
FIG. 6B is a flowchart illustrating exemplary operation of an audio decoding device in performing various aspects of the coding techniques described in this disclosure.

FIG. 6B is a flowchart illustrating exemplary operation of an audio decoding device in performing the coding techniques described in this disclosure. As shown in FIG. 6B, extraction unit 72 of audio decoding device 24 may receive a bitstream (160). Audio decoding device 24 may obtaining an audio object that has been closed loop quantized based at least in part on a result of performing quantization of directional information associated with the audio object (162). For example, extraction unit 72 of audio decoding device 24 may decode the bitstream to obtain the closed loop quantized audio object and the quantized directional information. Responsive to obtaining the audio object, audio decoding device 24 may dequantize the audio object (164).

In some example, the audio object is close looped quantized by quantizing the directional information associated with the audio object and quantizing the audio object based at least in part on a result of quantizing the directional information associated with the audio object. In some examples, the audio object is close looped quantized by quantizing the directional information associated with the audio object and quantizing the audio object based at least in part on a quantization error resulting from quantizing the directional information associated with the audio object.

In some examples, the audio object is close looped quantized by quantizing the directional information associated with the audio object and quantizing the audio object based at least in part on a quantization error resulting from quantizing of the directional information associated with the audio object, including compensating for the quantization error resulting from performing quantization of the directional information associated with the audio object. In some examples, the audio object is close looped quantized by quantizing the directional information associated with the audio object, determining a quantization-compensated audio object based at least in part on a pseudoinverse of a result of quantizing the directional information associated with the audio object, and quantizing the quantization-compensated audio object.

In some examples, the audio object is close looped quantized by determining the audio object as a product of Higher Order Ambisonics (HOA) coefficients and the pseudoinverse of the result of performing quantization of the directional information associated with the audio object. In some examples, the audio object and the directional information are decomposed from higher order ambisonic coefficients, the audio object comprises a product of a U matrix representative of left-singular vectors of a plurality of spherical harmonic coefficients and a S matrix representative of singular values of the plurality of spherical harmonic coefficients, and the directional information associated with the audio object comprises a V matrix representative of right-singular vectors of the plurality of spherical harmonic coefficients.

Figure 7A:
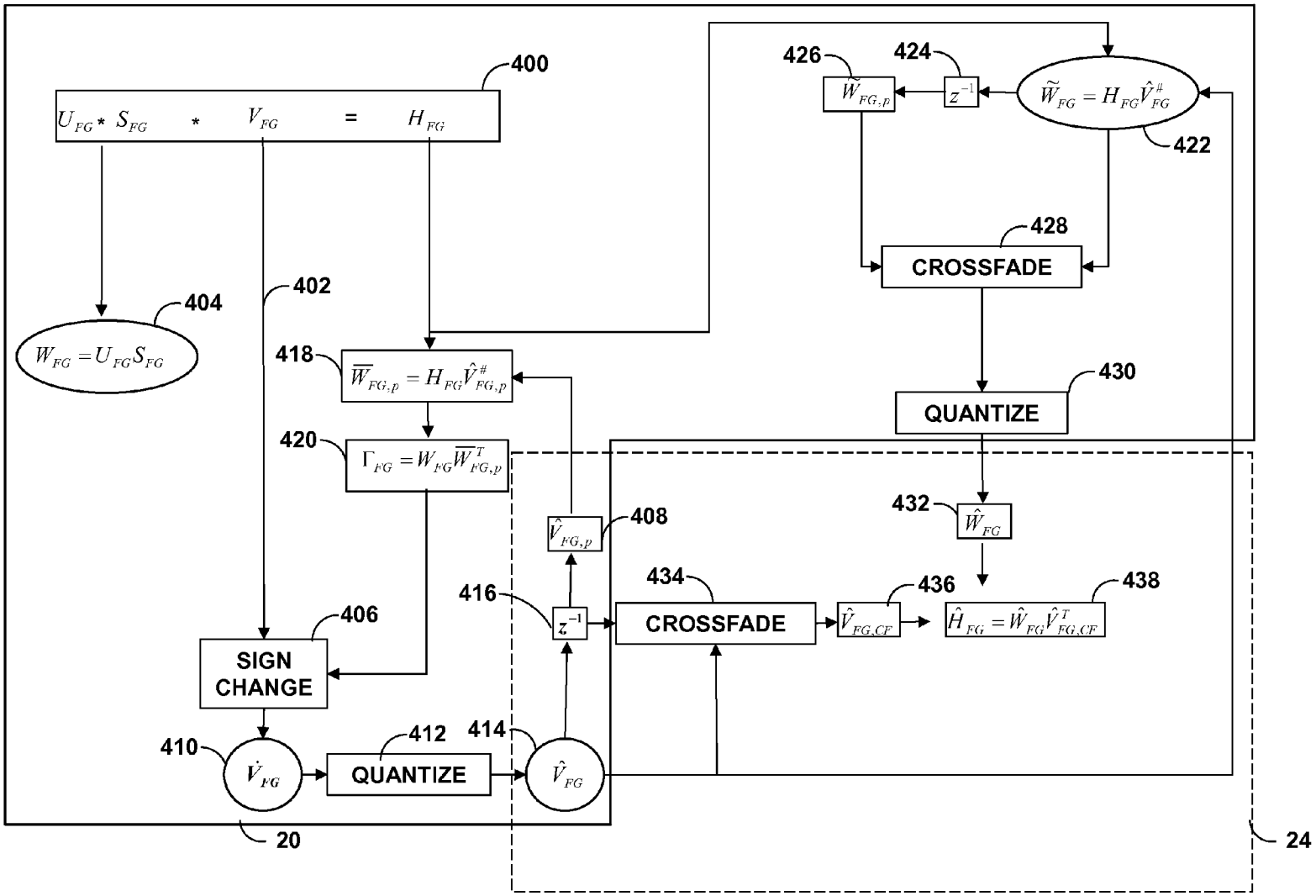
FIGS. 7A and 7B are block diagrams illustrating closed loop quantization of directional information in the form of one or more V vectors and audio objects in the form of foreground signals for HOA signal compression.

FIG. 7A is a block diagram illustrating closed loop quantization of the V vector and foreground signals for HOA signal compression. Such closed loop quantization may be performed by the audio encoding device 20 shown in the example of FIG. 3 and the audio decoding device 24 shown in the example of FIG. 4. To reduce quantization errors, a V vector may be quantized, and the US vector may be quantized by compensating for the quantization error of the V vector. The audio encoding device 20 may quantize the V vector into Q(V), and may generate a new target signal T(US) as a product of H and pinv(Q(V)), wherein pinv(A) is a pseudoinverse of A. The audio encoding device 20 may quantize T(US) into Q(T(US)). The audio decoding device 24 may reconstruct the HOA coefficients 11' based on quantized HOA coefficients Q(H) generated by Q(T(US)) *Q(V)'. In this way, the US vector may be quantized based on the quantization error of the V vector.

As shown in FIG. 7A, $H_{FG}$ may represent foreground HOA coefficients 400 having, in the example of FIG. 7A, a size of 1280 by 21. The foreground HOA coefficients 400 may equal the product of $U_{FG}$, $S_{FG}$, and $V_{FG}$, where $U_{FG}$ may have a size of 1280 by 2, $S_{FG}$ may have a size of 2 by 2, and where $V_{FG}$ may have a size of 21 by 2. V-vector $V_{FG}$ 402 may be the reduced foreground V[k] vectors 55 of FIG. 3 having, in the example of FIG. 7A, a size of 21 by 2. Original target $W_{FG}=U_{FG}*S_{FG}$ 404 may be interpolated nFG signals 49' of FIG. 3 having, in the example of FIG. 7A, a size of 1280 by 2.

Audio encoding device 20 may determine whether to perform sign change 406 on V-vector $V_{FG}$ 402 based at least in part on the quantized V-vector of a previous frame $\hat{V}_{FG,p}$ 408, as discussed in more detail below. Thus, audio encoding device 20 may determine whether there to change the sign of V-vector $V_{FG}$ 402 of the current frame based at least in part on the delayed quantized V-vector $\hat{V}_{FG,p}$ 408 of the previous frame. Audio encoding device 20 may determine whether to sign change 406 V-vector $V_{FG}$ 402 to result in either un-sign changed V-vector $V_{FG}$ 402 or sign changed V-vector $\dot{V}_{FG}$ 410. Audio encoding device 20 may quantize 412 either un-sign changed V-vector $V_{FG}$ 402 or sign changed V-vector $\dot{V}_{FG}$ 410, such as by using quantization unit 52 of audio encoding device 20, to generate quantized foreground V-vector $\hat{V}_{FG}$ 414, which may be the coded foreground V[k] vectors 57 of FIG. 3. Audio encoding device may delay 416 quantized foreground V-vector $\hat{V}_{FG}$ 414 by a frame to generate delayed quantized V-vector $\hat{V}_{FG,p}$ 408 so that the audio encoding device 20 may use the quantized V-vector $\hat{V}_{FG}$ in the next frame to determine whether to perform the sign change on the V-vector $V_{FG}$ for that next frame.

Audio encoding device 20 may, based on delayed quantized V-vector $\hat{V}_{FG,p}$ 408, determine $\overline{W}_{FG,p}=H_{FG}\hat{V}_{FG,p}^{\#}$ 418, which is a product of foreground HOA coefficients 400 and $\hat{V}_{FG,p}^{\#}$, which is the pseudoinverse of the delayed quantized V-vector $\hat{V}_{FG,p}$ 408. Audio encoding device 200 may also determine $\Gamma_{FG}=W_{FG}\overline{W}_{FG,p}^{T}$ 420, which is a product of $W_{FG}=U_{FG}*S_{FG}$ 404 and $\overline{W}_{FG,p}=H_{FG}\hat{V}_{FG,p}^{\#}$ 418. Based at least in part on determining $\Gamma_{FG}=W_{FG}\overline{W}_{FG,p}^{T}$ 420, the audio encoding device 20 may perform the sign change 406 on V-vector $V_{FG}$ 402. For example, the audio encoding device 20 may perform the sign change 406 on V-vector $V_{FG}$ 402 if the sign of $\Gamma_{FG}=W_{FG}\overline{W}_{FG,p}^{T}$ 420 is negative.

Audio encoding device 20 may generate, based at least in part on the quantized V-vector $\hat{V}_{FG}$ 408, a new target 422 $\tilde{W}_{FG}$ that is the product of $\hat{V}_{FG}^{\#}$, which is the pseudoinverse of the quantized V-vector $\hat{V}_{FG}$ 408, and $H_{FG}$, which may represent foreground HOA coefficients 400, such that the new target 422 $\tilde{W}_{FG}=H_{FG}\hat{V}_{FG}^{\#}$. The audio encoding device 20 may delay 424 the new target 422 $\tilde{W}_{FG}=H_{FG}\hat{V}_{FG}^{\#}$ by a frame to produce previous target 426 $\tilde{W}_{FG,p}$, and may crossfade 428 a first portion of the new target 422 $\tilde{W}_{FG}$, such as first 256 samples, with a last portion of the previous target 426 $\tilde{W}_{FG,p}$, such as the last 256 samples, to produce a quantization-compensated target signal, similar to the quantization-compensated nFG signals 60 in FIG. 3. Audio encoding device 20 may quantize 430 the quantization-compensated target signal, such as by using psychoacoustic audio coder unit 40 of FIG. 3, to produce quantized foreground signals 432 $\hat{W}_{FG}$ that are output to the audio decoding device 24.

The audio decoding device 24 may receive quantized foreground V-vector $\hat{V}_{FG}$ 414 from, for example, audio encoding device 20 and may delay 416 quantized foreground V-vector $\hat{V}_{FG}$ 414 by a frame to generate delayed quantized V-vector $\hat{V}_{FG,p}$ 408. The audio decoding device 24 may crossfade a first number of samples of the quantized foreground V-vector $\hat{V}_{FG}$ 414 of the current frame with a last number samples of delayed quantized V-vector $\hat{V}_{FG,p}$ 408, and may determine a product of the crossfaded quantized foreground V[k] vectors 436 $\hat{V}_{FG,CF}$ with the quantized foreground signals 432 $\hat{W}_{FG}$ to produce quantized foreground HOA coefficients 438 $\hat{H}_{FG}=\hat{W}_{FG}\hat{V}_{FG,CF}^{T}$. For example, audio decoding device 24 may crossfade the first 256 samples of the quantized foreground V-vector $\hat{V}_{FG}$ 414 of the current frame with the last 256 samples of the delayed quantized V-vector $\hat{V}_{FG,p}$ 408, and may determine a product of the crossfaded quantized foreground V[k] vectors 436 $\hat{V}_{FG,CF}$ with the quantized foreground signals 432 $\hat{W}_{FG}$ to produce quantized foreground HOA coefficients 438 $\hat{H}_{FG}=\hat{W}_{FG}\hat{V}_{FG,CF}^{T}$. Audio decoding device 24 may decompose and dequantized foreground HOA coefficients 438 such that a speaker may playback loudspeaker feeds rendered from the dequantized audio objects decomposed from quantized foreground HOA coefficients 438.

Figure 7B:
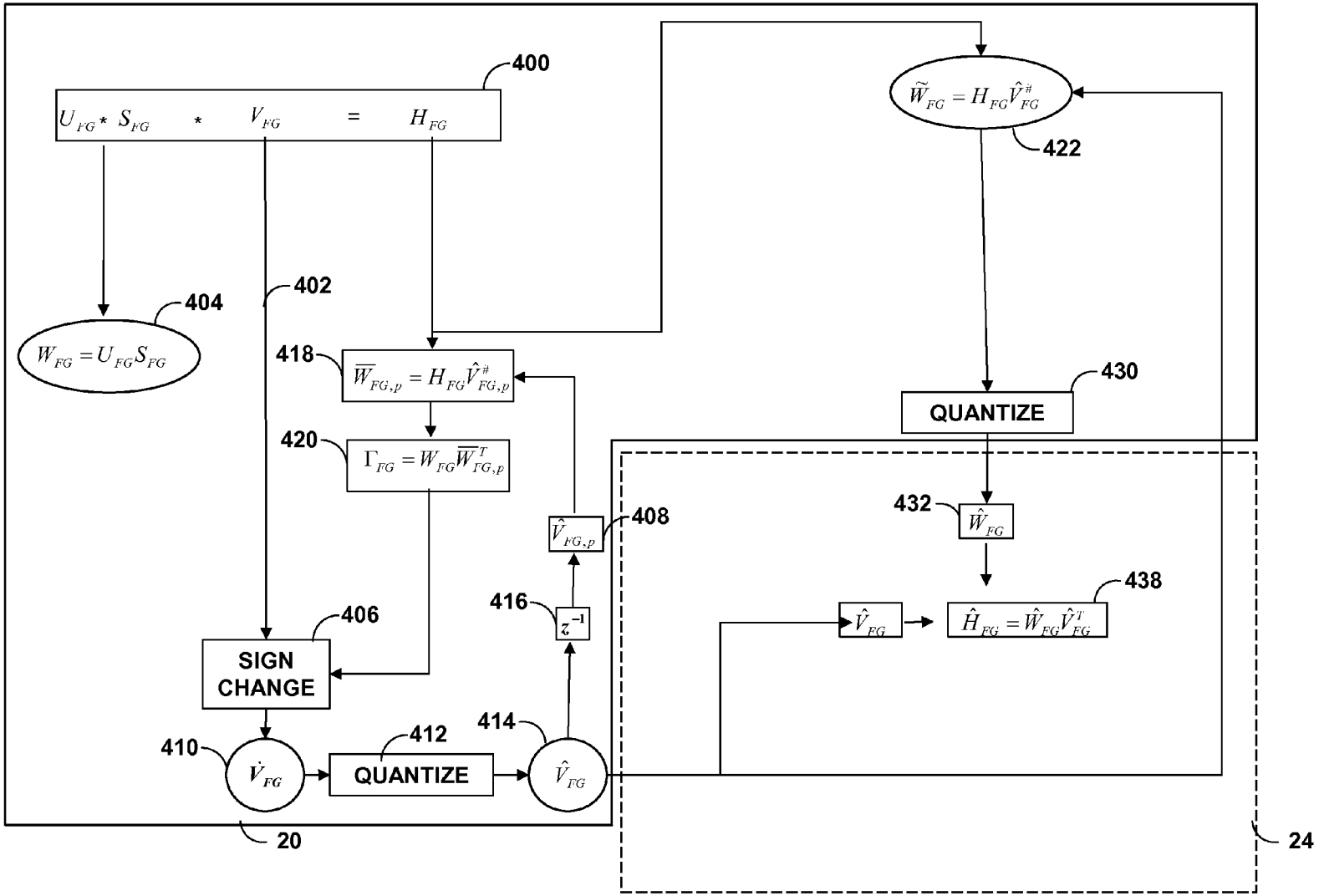

FIG. 7B is a block diagram illustrating closed loop quantization of the V vector and foreground signals for HOA signal compression. FIG. 7B differs from FIG. 7A in that audio decoding device 24 as shown in FIG. 7B does not crossfade a first number of samples of quantized foreground V-vector $\hat{V}_{FG}$ 414 of the current frame with a last number samples of delayed quantized V-vector $\hat{V}_{FG,p}$ 408. FIG. 7B also differs from FIG. 7A in that audio encoding device 20 as shown in FIG. 7B does not delay the new target 422 $\tilde{W}_{FG}=H_{FG}\hat{V}_{FG}^{\#}$ by a frame to produce previous target, and thus does not crossfade a first portion of the new target 422 $\tilde{W}_{FG}$ with a last portion of the previous target 4 to produce a quantization-compensated target signal.

The foreground HOA coefficients 400 may equal the product of $U_{FG}$, $S_{FG}$, and $V_{FG}$, where $U_{FG}$ may have a size of 1280 by 2, $S_{FG}$ may have a size of 2 by 2, and where $V_{FG}$ may have a size of 21 by 2. V-vector $V_{FG}$ 402 may be the reduced foreground V[k] vectors 55 of FIG. 3 having, in the example of FIG. 7A, a size of 21 by 2. Original target $W_{FG}=U_{FG}*S_{FG}$ 404 may be interpolated nFG signals 49' of FIG. 3 having, in the example of FIG. 7A, a size of 1280 by 2.

Audio encoding device 20 may determine whether to perform sign change 406 on V-vector $V_{FG}$ 402 based at least in part on the quantized V-vector of a previous frame $\hat{V}_{FG,p}$ 408, as discussed in more detail below. Thus, audio encoding device 20 may determine whether there to change the sign of V-vector $V_{FG}$ 402 of the current frame based at least in part on the delayed quantized V-vector $\hat{V}_{FG,p}$ 408 of the previous frame. Audio encoding device 20 may determine whether to sign change 406 V-vector $V_{FG}$ 402 to result in either un-sign changed V-vector $V_{FG}$ 402 or sign changed V-vector $\dot{V}_{FG}$ 410. Audio encoding device 20 may quantize 412 either un-sign changed V-vector $V_{FG}$ 402 or sign changed V-vector $\dot{V}_{FG}$ 410, such as by using quantization unit 52 of audio encoding device 20, to generate quantized foreground V-vector $\hat{V}_{FG}$ 414, which may be the coded foreground V[k] vectors 57 of FIG. 3. Audio encoding device may delay 416 quantized foreground V-vector $\hat{V}_{FG}$ 414 by a frame to generate delayed quantized V-vector $\hat{V}_{FG,p}$ 408 so that the audio encoding device 20 may use the quantized V-vector $\hat{V}_{FG}$ in the next frame to determine whether to perform the sign change on the V-vector $V_{FG}$ for that next frame.

Audio encoding device 20 may, based on delayed quantized V-vector $\hat{V}_{FG,p}$ 408, determine $\overline{W}_{FG,p}=H_{FG}\hat{V}_{FG,p}^{\#}$ 418, which is a product of foreground HOA coefficients 400 and $\hat{V}_{FG,p}^{\#}$, which is the pseudoinverse of the delayed quantized V-vector $\hat{V}_{FG,p}$ 408. Audio encoding device 200 may also determine $\Gamma_{FG}=W_{FG}\overline{W}_{FG,p}^{T}$ 420, which is a product of $W_{FG}=U_{FG}*S_{FG}$ 404 and $\overline{W}_{FG,p}=H_{FG}\hat{V}_{FG,p}^{\#}$ 418. Based at least in part on determining $\Gamma_{FG}=W_{FG}\overline{W}_{FG,p}^{T}$ 420, the audio encoding device 20 may perform the sign change 406 on V-vector $V_{FG}$ 402. For example, the audio encoding device 20 may perform the sign change 406 on V-vector $V_{FG}$ 402 if the sign of $\Gamma_{FG}=W_{FG}\overline{W}_{FG,p}^{T}$ 420 is negative.

Audio encoding device 20 may generate, based at least in part on the quantized V-vector $\hat{V}_{FG}$ 408, a new target 422 $\tilde{W}_{FG}$ that is the product of $\hat{V}_{FG}^{\#}$, which is the pseudoinverse of the quantized V-vector $\hat{V}_{FG}$ 408, and $H_{FG}$, which may represent foreground HOA coefficients 400, such that the new target 422 $\tilde{W}_{FG}=H_{FG}\hat{V}_{FG}^{\#}$. Audio encoding device 20 may quantize 430 the new target 422 $\tilde{W}_{FG}=H_{FG}\hat{V}_{FG}^{\#}$ to generate quantized foreground signals 432 $\hat{W}_{FG}$. Audio decoding device 24 may receive quantized foreground V-vector $\hat{V}_{FG}$ 414 from, for example, audio encoding device 20 and may determine a product of the quantized foreground V-vector $\hat{V}_{FG}$ 414 with the quantized foreground signals 432 $\hat{W}_{FG}$ to produce quantized foreground HOA coefficients 438 $\hat{H}_{FG}=\hat{W}_{FG}\hat{V}_{FG}^{T}$. Audio decoding device 24 may decompose and dequantized foreground HOA coefficients 438 such that a speaker may playback loudspeaker feeds rendered from the dequantized audio objects decomposed from dequantized foreground HOA coefficients 438.

Figure 8:
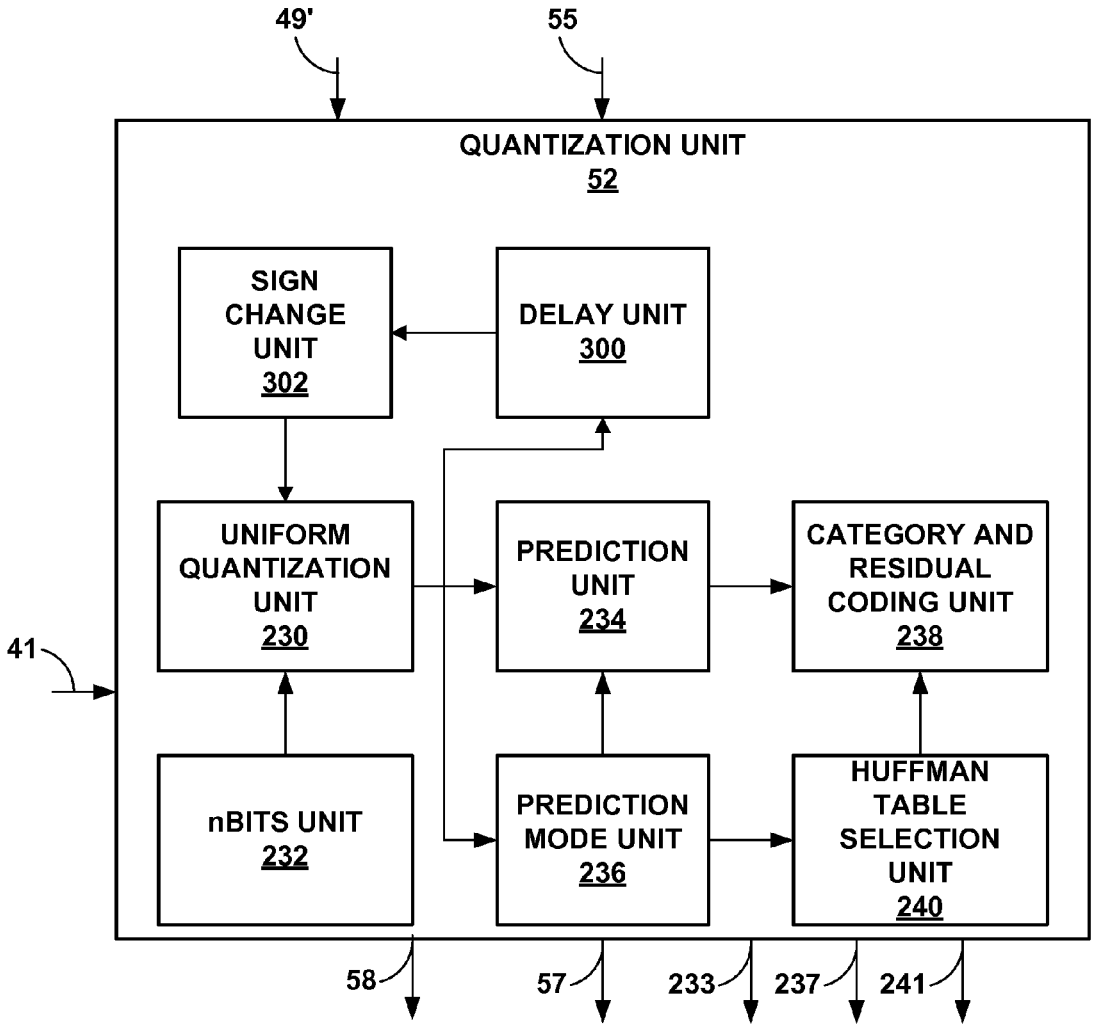
FIG. 8 is a block diagram illustrating, in more detail, one example of the quantization unit of the audio encoding device shown in the example of FIG. 3.

FIG. 8 is a block diagram illustrating, in more detail, the quantization unit 52 of the audio encoding device 20 shown in the example of FIG. 3. In the example of FIG. 8, the quantization unit 52 includes a uniform quantization unit 230, a nbits unit 232, a prediction unit 234, a prediction mode unit 236 ("Pred Mode Unit 236"), a category and residual coding unit 238, a Huffman table selection unit 240, a delay unit 300, and a sign change unit 302. The uniform quantization unit 230 represents a unit configured to perform the uniform quantization described above with respect to one of the spatial components (which may represent any one of the reduced foreground V[k] vectors 55). The nbits unit 232 represents a unit configured to determine the nbits parameter or value.

The delay unit 300 may delay, by a frame, the result of the uniform quantization unit 230, so that sign change unit 302 may determine, based at least in part on the quantized foreground V[k] vectors, whether to perform a sign change on the reduced foreground V[k] vectors 55 before the uniform quantization unit 230 acts upon the reduced foreground V[k] vectors 55. The sign change unit 302 may, in other words, represent a unit configured to invert the sign (from positive to negative or negative to positive) for one or more of the reduced foreground V[k] vectors 55. Given the nature of the linear invertible transform, the V[k] vectors 55 may be decomposed from the HOA coefficients 11 for the k-th frame such that a corresponding one or more of the V[k−1] vectors 55 of the previous frame (or (k−1)-th frame) are inverted sign-wise. In this respect, there may sometimes be a need to change signs across frame boundaries. Thus, whether there is a need to change the sign of the reduced foreground V[k] vectors 55 of the current frame may depend on the quantized V-vector of the previous frame. Specifically, quantization unit 54 may multiply the HOA coefficients 11 for the k-th frame and the quantized V-vector of the previous frame (k−1 frame) to generate delayed foreground signals. Quantization unit 54 may multiply the delayed foreground signals with the interpolated nFG signals 49'. If the result of multiplying the delayed foreground signals with the interpolated nFG signals 49' is negative, then sign change unit 302 may perform a sign change on the reduced foreground V[k] vectors 55.

Figure 9:
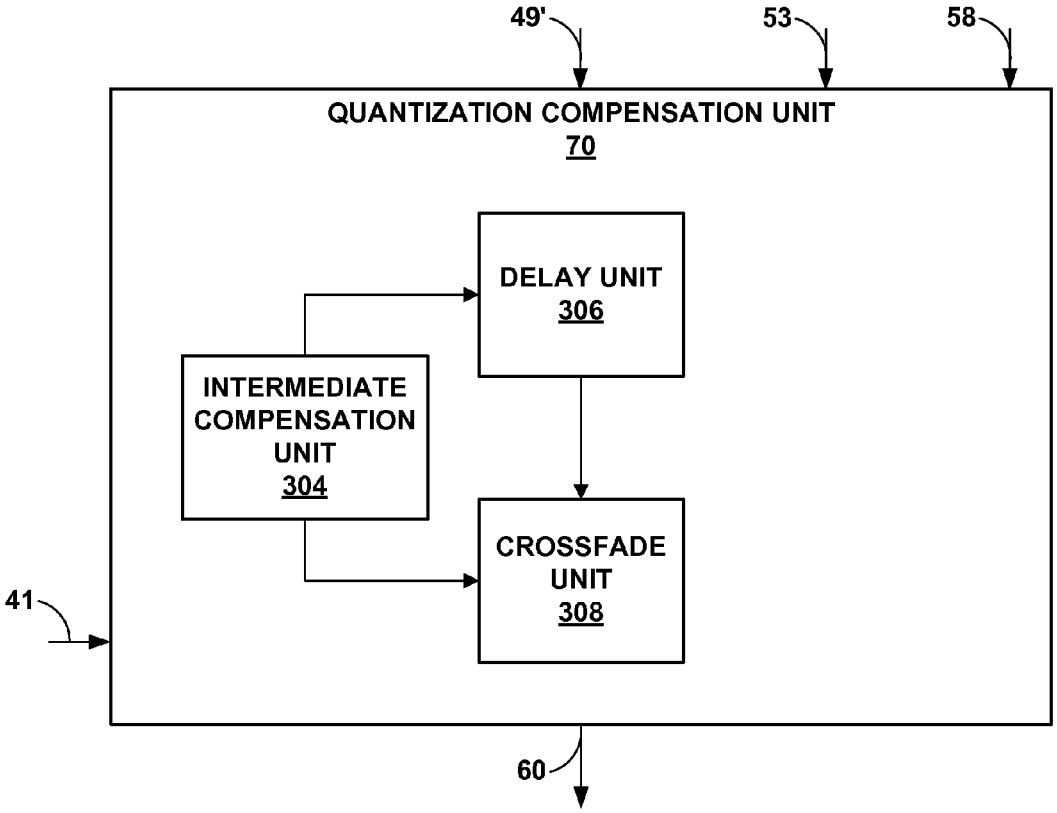
FIG. 9 is a block diagram illustrating, in more detail, one example of the quantization compensation unit of the audio encoding device shown in the example of FIG. 3.

FIG. 9 is a block diagram illustrating, in more detail, the quantization compensation unit 70 of the audio encoding device 20 shown in the example of FIG. 3. The quantization compensation unit 70 may include intermediate compensation unit 304, delay unit 306, and crossfade unit 308. Intermediate compensation unit 304 may perform a pseudo-inverse function on the coded foreground V[k] vectors 57 to obtain a pseudoinverse of the coded foreground V[k] vectors 57. The intermediate compensation unit 304 may further compute a product of the pseudoinverse of the coded foreground V[k] vectors 57 and the foreground HOA coefficients to determine an intermediate quantization-compensated nFG signals. In one example, the intermediate compensation unit 304 may determine the foreground HOA coefficients as the product of the interpolated nFG signals 49' and the interpolated foreground V[k] vectors 53.

Delay unit 306 may delay the intermediate quantization-compensated nFG signals produced by intermediate compensation unit 304 by one frame. Crossfade unit 308 may crossfade a portion of the intermediate quantization-compensated nFG signals of the current frame k outputted by intermediate compensation unit 304 with a portion of the intermediate quantization-compensated nFG signals of the previous frame k−1 outputted by delay unit 306 to produce the quantization-compensated nFG signals 60. For instance, crossfade unit 308 may crossfade the first 256 samples of the intermediate quantization-compensated nFG signals of the current frame k with the last 256 samples of the intermediate quantization-compensated nFG signals of the previous frame k−1 to produce the quantization-compensated nFG signals 60 of size 1024 by 2.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoding device 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoding device 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to audio decoding device 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A method for quantizing a foreground audio signal, comprising:

receiving, by at least one processor, audio data indicative of Higher Order Ambisonics (HOA) coefficients captured by a microphone;

decomposing, by the at least one processor, an audio object and directional information associated with the audio object from the HOA coefficients; and performing, by the at least one processor, closed loop quantization of the audio object based at least in part on a result of performing quantization of the directional information associated with the audio object.

2. The method of claim 1, wherein performing the closed loop quantization of the audio object further comprises:

performing quantization of the directional information associated with the audio object; and performing quantization of a the audio object based at least in part on a result of performing quantization of the directional information associated with the audio object.

3. The method of claim 2, wherein performing quantization of the audio object further comprises:

performing quantization of the audio object based at least in part on a quantization error resulting from performing quantization of the directional information associated with the audio object.

4. The method of claim 3, wherein performing quantization of the audio object based at least in part on the quantization error resulting from performing quantization of the directional information associated with the audio object further comprises:

compensating for the quantization error resulting from performing quantization of the directional information associated with the audio object.

5. The method of claim 4, wherein compensating for the quantization error resulting from performing quantization of the directional information associated with the audio object further comprises:

determining a quantization-compensated audio object based at least in part on a pseudoinverse of a result of performing quantization of the directional information associated with the audio object; and performing quantization of the quantization-compensated audio object.

6. The method of claim 5, wherein determining the quantization-compensated audio object based at least in part on the pseudoinverse of the result of performing quantization of the directional information associated with the audio object further comprises:

determining the quantization-compensated audio object as a product of the HOA coefficients and the pseudoinverse of the result of performing quantization of the directional information associated with the audio object.

7. The method of claim 1, wherein:

the audio object comprises a product of a U matrix representative of left-singular vectors of a plurality of spherical harmonic coefficients and a S matrix representative of singular values of the plurality of spherical harmonic coefficients; and the directional information associated with the audio object comprises a V matrix representative of right-singular vectors of the plurality of spherical harmonic coefficients.

8. The method of claim 1, further comprising:

capturing, by the microphone, the audio data indicative of the HOA coefficients.

9. A device for quantizing a foreground audio signal, comprising:

at least one processor configured to:

receive audio data indicative of Higher Order Ambisonics (HOA) coefficients captured by a microphone;

decompose an audio object and directional information associated with the audio object from the HOA coefficients; and perform closed loop quantization of the audio object based at least in part on a result of performing quantization of the directional information associated with the audio object; and a memory configured to store the audio object and the directional information associated with the audio object.

10. The device of claim 9, wherein the at least one processor is further configured to:

perform quantization of the directional information associated with the audio object; and perform quantization of the audio object based at least in part on a result of performing quantization of the directional information associated with the audio object.

11. The device of claim 10, wherein performing quantization of the audio object further comprises:

perform quantization of the audio object based at least in part on a quantization error resulting from performing quantization of the directional information associated with the audio object.

12. The device of claim 11, wherein the at least one processor is further configured to:

compensate for the quantization error resulting from performing quantization of the directional information associated with the audio object.

13. The device of claim 12, wherein the at least one processor is further configured to:

determine a quantization-compensated audio object based at least in part on a pseudoinverse of a result of performing quantization of the directional information associated with the audio object; and perform quantization of the quantization-compensated audio object.

14. The device of claim 13, wherein the at least one processor is further configured to:

determine the audio object as a product of the HOA coefficients and the pseudoinverse of the result of performing quantization of the directional information associated with the audio object.

15. The device of claim 9, further comprising:

a microphone configured to capture the audio data indicative of HOA coefficients.

16. A method for dequantizing an audio object, comprising:

obtaining, by at least one processor, an audio object that has been closed loop quantized based at least in part on a result of performing quantization of directional information associated with the audio object; and dequantizing, by the at least one processor, the audio object;

rendering, by the at least one processor using the dequantized audio object, loudspeaker feeds; and outputting, by the at least one processor, the loudspeaker feeds to drive one or more speakers to playback the loudspeaker feeds.

17. The method of claim 16, wherein the audio object is close looped quantized by quantizing the directional information associated with the audio object and quantizing the audio object based at least in part on a result of quantizing the directional information associated with the audio object.

18. The method of claim 16, wherein the audio object is close looped quantized by quantizing the directional information associated with the audio object and quantizing the audio object based at least in part on a quantization error resulting from quantizing the directional information associated with the audio object.

19. The method of claim 16, wherein the audio object is close looped quantized by quantizing the directional information associated with the audio object and quantizing the audio object based at least in part on a quantization error resulting from quantizing of the directional information associated with the audio object, including compensating for the quantization error resulting from performing quantization of the directional information associated with the audio object.

20. The method of claim 16 wherein the audio object is close looped quantized by quantizing the directional information associated with the audio object, determining a quantization-compensated audio object based at least in part on a pseudoinverse of a result of quantizing the directional information associated with the audio object, and quantizing the quantization-compensated audio object.

21. The method of claim 20, wherein the audio object is close looped quantized by determining the quantization-compensated audio object as a product of Higher Order Ambisonics (HOA) coefficients and the pseudoinverse of the result of performing quantization of the directional information associated with the audio object.

22. The method of claim 16, wherein:

the audio object and the directional information are decomposed from higher order ambisonic coefficients;

the audio object comprises a product of a U matrix representative of left-singular vectors of a plurality of spherical harmonic coefficients and a S matrix representative of singular values of the plurality of spherical harmonic coefficients; and the directional information associated with the audio object comprises a V matrix representative of right-singular vectors of the plurality of spherical harmonic coefficients.

23. The method of claim 16, further comprising:

receiving a bitstream; and decoding the bitstream to obtain the closed loop quantized audio object and the quantized directional information.

24. The method of claim 16, further comprising:

playing back, by the one or more speakers, the loudspeaker feeds rendered from the dequantized audio object.

25. A device for dequantizing a foreground audio signal, comprising:

a memory configured to store an audio object;

at least one processor configured to:

obtain the audio object that has been closed loop quantized based at least in part on a result of performing quantization of directional information associated with the audio object;

dequantize the audio object;

render, using the dequantized audio object, loudspeaker feeds; and output the loudspeaker feeds to drive one or more speakers to playback the loudspeaker feeds; and the one or more speakers configured to playback the loudspeaker feeds rendered from the dequantized audio object.

26. The device of claim 25, wherein the audio object is close looped quantized by quantizing the directional information associated with the audio object and quantizing the audio object based at least in part on a result of quantizing the directional information associated with the audio object.

27. The device of claim 25, wherein the audio object is close looped quantized by quantizing the directional information associated with the audio object and quantizing the audio object based at least in part on a quantization error resulting from quantizing the directional information associated with the audio object.

28. The device of claim 25, wherein the audio object is close looped quantized by quantizing the directional information associated with the audio object and quantizing the audio object based at least in part on a quantization error resulting from quantizing of the directional information associated with the audio object, including compensating for the quantization error resulting from performing quantization of the directional information associated with the audio object.

29. The device of claim 25 wherein the audio object is close looped quantized by quantizing the directional information associated with the audio object, determining a quantization-compensated audio object based at least in part on a pseudoinverse of a result of quantizing the directional information associated with the audio object, and quantizing the quantization-compensated audio object.

30. The device of claim 29, wherein the audio object is close looped quantized by determining the quantization-compensated audio object as a product of Higher Order Ambisonics (HOA) coefficients and the pseudoinverse of the result of performing quantization of the directional information associated with the audio object.

31. The device of claim 25, wherein the at least one processor is further configured to:

receiving a bitstream; and decoding the bitstream to obtain the closed loop quantized audio object and the quantized directional information.

32. The device of claim 25, further comprising:

the one or more speakers configured to playback the loudspeaker feeds rendered from the dequantized audio object.

* * * * *